US005383762A

United States Patent [19]

Jacobsson

[11] Patent Number: 5,383,762

[45] Date of Patent: Jan. 24, 1995

[54] PNUEMATIC TURBINE

[75] Inventor: Rolf A. Jacobsson, Saltsjö-Boo, Sweden

[73] Assignee: Atlas Copco Tools AB, Nacka, Sweden

[21] Appl. No.: 206,025

[22] Filed: Mar. 2, 1994

Related U.S. Application Data

[63] Continuation of Ser. No. 73,767, Jun. 8, 1993, abandoned.

[30] Foreign Application Priority Data

Jun. 16, 1992 [SE] Sweden ..... 9201845-6

[51] Int. Cl.[6] ..... F04D 29/70

[52] U.S. Cl. ..... 415/121.2

[58] Field of Search ..... 415/121.2, 182, 202

[56] References Cited

U.S. PATENT DOCUMENTS

| | | | |
|---|---|---|---|
| 2,494,328 | 1/1950 | Bloomberg | 415/121.2 |
| 2,802,618 | 8/1957 | Prachar | 415/121.2 |
| 3,066,912 | 12/1962 | Scheper, Jr. . | |
| 3,274,757 | 9/1966 | Wapler . | |
| 3,944,380 | 3/1976 | Kampe . | |
| 4,097,188 | 6/1978 | Forster | 415/202 |
| 4,236,868 | 12/1980 | Linhardt . | |
| 4,684,321 | 8/1987 | Barrett et al. | 415/202 |
| 4,776,765 | 10/1988 | Sumner et al. | 415/181 |
| 4,780,057 | 10/1988 | Silvestri, Jr. | 415/202 |
| 4,971,518 | 11/1990 | Florin | 415/121.2 |

*Primary Examiner*—John T. Kwon

*Attorney, Agent, or Firm*—Frishauf, Holtz, Goodman & Woodward

[57] ABSTRACT

A pneumatic turbine, comprising a turbine wheel (13) with a peripheral row of blades (14) and a stator housing (10) having nozzles (11) for directing motive air at high speed onto the blades (14) to rotate the turbine wheel (13), an exhaust passage (15) located downstream the turbine wheel (13), and a particle escape passage (20) located on the same side of the turbine wheel (13) as the air nozzles (11) to drain from the turbine harmful particles and, thereby, avoid a blasting effect of such particles on the turbine wheel blades (14).

4 Claims, 1 Drawing Sheet

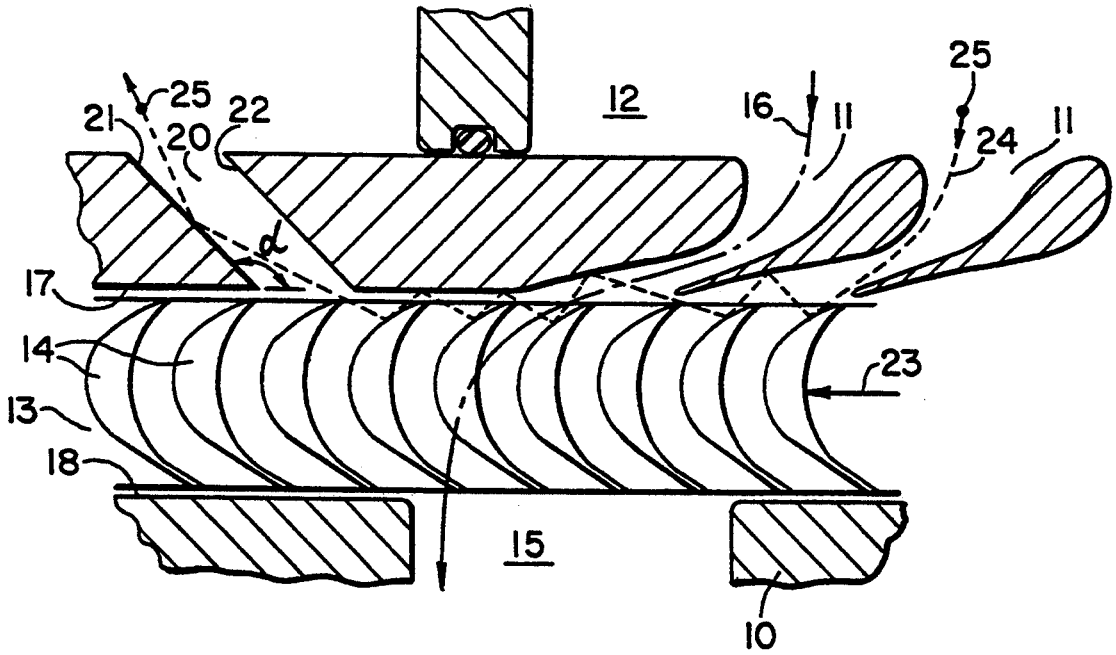
25
21
20
22
12
16
11
25
24
11
α
17
14
23
13
18
15
10

PNUEMATIC TURBINE

This application is a continuation, of application Ser. No. 08/073,767 filed Jun. 8 1993, now abandoned.

BACKGROUND OF THE INVENTION

The invention pertains to a pneumatically powered turbine which comprises a turbine wheel with a peripheral row of blades, and a stator housing having one or more nozzles for directing motive air at high speed onto said blades to rotate said turbine wheel, and an air outlet located substantially opposite said nozzle or nozzles in the axial direction and downstream of the turbine wheel.

A problem inherent in turbines of the above type relates to mechanical blade wear due to hard particles bouncing between the stator housing inner wall and the blades without being able to pass the blades and reach the outlet. This is a problem particularly with smaller turbines where realtively soft materials are used for the turbine wheel and the blades, e.g. aluminum alloy or plastics. Due to a very high peripheral velocity, particles that may have gotten into the turbine through the air inlet during operation or which may have been "installed" in the turbine at the assembly of the turbine cause very rapidly deformations of the blades. The result is an impaired efficiency of the turbine and a shortened service life.

BRIEF DESCRIPTION OF THE DRAWING

A preferred embodiment of the invention is described below with reference to the accompanying drawing which illustrates a fractional section through a pneumatic turbine according to the invention.

DETAILED DESCRIPTION

The drawing FIGURE shows a pneumatically powered turbine which comprises a housing 10 provided with a number of air nozzles 11, a turbine wheel 13 formed with a peripheral row of blades 14, and an exhaust passage 15. The upstream ends of the air nozzles 11 communicate with a pressure air inlet passage 12 in the housing 10 to receive and direct at high velocity motive air onto the turbine blades 14 to, thereby, rotate the turbine wheel 13. The air flow through the turbine during operation is illustrated by the dash dotted line 16.

The turbine wheel 13 runs between two parallel walls 17, 18 in the housing 10 through which walls 17, 18 the air nozzles 11 and the exhaust passage 15, respectively, extend. In the housing wall 17 containing the air nozzles 11, there is a particle escape passage 20. The latter is defined by one or more walls 21, 22, one of which 21 is facing a direction substantially opposite the movement direction of the turbine blades 14, indicated by the arrow 23. This wall 21 is inclined in relation to the turbine wheel rotation plane by an angle $\alpha$ of 90° or more.

The purpose of the particle escape passage 20 is to make it possible for particles that might have gotten into the turbine to get out thereof before causing any wear or damage to the turbine wheel blades 14. To this end, it is of importance that the inclination angle $\alpha$ of the wall 21 is large enough to prevent such particles to rebounce back into the turbine wheel blades 14 and not leave the turbine as desired. As being illustrated by the dash line 24, a particle 25 entering the turbine through the nozzles 11, bounces on the blades 14 and the housing and nozzle surfaces alternatingly until it reaches the escape passage 20. Then, the particle 25 enters the escape passage 20, hits the inclined wall 21 and continues out of the turbine.

Preferably, the inclination angle $\alpha$ of the escape passage wall 21 exceeds 90° to ensure an efficient draining of harmful particles.

In the drawing figure the escape passage 20 is illustrated to be located close to the air nozzles 11. The location of the escape passage 20, however, is not critical. Particles that travel with the turbine wheel 13 for just a portion of one revolution, no matter if the rotation angle is 20 or 120 degrees, will have no harmful influence on the blades 14. The factor is that such particles can not work the blades 14 in a blasting manner for thousands of revolutions.

It is also to be noted that the invention is not limited to the above described example in which a single particle escape passage is employed. On the contrary, it might even be desirable to have more than one such passage to facilitate particle drainage from the turbine.

I claim:

1. In a pneumatic turbine comprising a rotatable turbine wheel (13) having a peripheral row of blades (14); a stator housing (10) having a first wall (17) and a second wall (18) which are parallel to each other and which surround said turbine wheel (13); at least one nozzle (11) located in said first wall (17) for directing motive air onto said blades (14) to rotate said turbine wheel (13); and an air outlet (15) located in said second wall (18) substantially opposite to said at least one nozzle (11), the improvement wherein:

said stator housing (10) comprises at least one particle escape passage (20) communicating with the atmosphere and located in said first wall (17);

said at least one particle escape passage (20) comprises a wall means (21) facing substantially in a direction different from a movement direction of said blades (14); and said wall means (21) forms an angle ($\alpha$) of at least 90° with the rotation plane of said turbine wheel (13).

2. The pneumatic turbine of claim 1, wherein said wall means (21) faces a direction opposite to a movement direction of said blades.

3. The pneumatic turbine of claim 2, wherein said wall means (21) forms an angle ($\alpha$) greater than 90° with the rotation plane of said turbine wheel (13).

4. The pneumatic turbine of claim 1, wherein said wall means (21) forms an angle ($\alpha$) greater than 90° with the rotation plane of said turbine wheel (13).

* * * * *